US005437390A

United States Patent [19]

Romick

[11] Patent Number: 5,437,390

[45] Date of Patent: Aug. 1, 1995

[54] MEDICATION CONTROL AND DISPENSING PACKAGE ASSEMBLAGE

[76] Inventor: Jerome M. Romick, Artromick International, Inc., 4800 Hilton Corp. Dr., Columbus, Ohio 43232

[21] Appl. No.: 16,249

[22] Filed: Feb. 11, 1993

[51] Int. Cl.[6] ..... B65D 25/10

[52] U.S. Cl. ..... 220/768; 220/23.86; 220/212.5; 220/528; 220/729; 220/759; 229/117.19; 229/117.23; 206/538

[58] Field of Search ..... 220/23.83, 23.86, 212, 220/334, 528, 729, 759, 768, 260, 263; 229/117.19, 117.23; 206/538

[56] References Cited

U.S. PATENT DOCUMENTS

| | | | |
|---|---|---|---|
| 333,123 | 12/1885 | Goldsmith . | |
| 1,517,148 | 11/1924 | Canfield . | |
| 2,233,699 | 3/1941 | Gorrell . | |
| 2,783,115 | 2/1957 | York . | |
| 3,276,660 | 10/1966 | Vesak | 229/117.19 |
| 3,297,350 | 1/1967 | Hidding | 229/117.19 X |
| 3,738,723 | 6/1973 | Rudolph et al. | 220/23.86 X |
| 4,691,860 | 9/1987 | Kluygis | 229/117.19 |
| 4,741,441 | 5/1988 | Keffeler | 220/528 X |
| 4,813,753 | 3/1989 | Relyea . | |
| 5,011,018 | 4/1991 | Keffeler | 220/528 X |
| 5,108,004 | 4/1992 | Baldwin | 220/522 |
| 5,209,366 | 6/1993 | Timson | 220/260 |

*Primary Examiner*—Allan N. Shoap
*Assistant Examiner*—Stephen Cronin
*Attorney, Agent, or Firm*—Vorys, Sater, Seymour & Pease

[57] ABSTRACT

An improved medication dispensing and control assembly is disclosed in which a carton has sidewalls defining a medication dispensing opening, which carton has a bendable top wall connected to the sidewalls in such a manner as to allow the top wall to move between a position closing the medication opening and opened positions allowing removal of medication from the cartons. A frame is removably attached to the top wall so as to maintain planarity of the top wall to thereby facilitate carton opening and closing and maintaining the top wall portion in a closed condition and to resist any undesired bending thereof.

13 Claims, 4 Drawing Sheets

MEDICATION CONTROL AND DISPENSING PACKAGE ASSEMBLAGE

BACKGROUND OF THE INVENTION

The present invention relates generally to a medication control and dispensing assemblage and, in particular, to such an assemblage including an improved combination of a container lid frame attachment and associated drug dispensing container.

In the medical dispensing field, a wide variety of approaches exist for assuring that the patient receives their medication from medication dispensing devices. One known dispensing system includes the utilization of a medication containing and dispensing carton. Typically, these cardboard cartons are filled by a pharmacist with individually packaged medicines. Thereafter, the cartons are closed and labeled by the pharmacist for subsequent use. Generally, each carton is opened by a nurse or other person in charge of administering the medicine. In this regard, the carton is provided with a top or lid which when in the open condition defines a medication dispensing opening. Usually, the upper surface of the lid contains a label from the pharmacist so that the medication can be properly dispensed. During the administering of medication from these cartons, if the lids are not closed there is a chance of spilling or other inadvertent transfers of medication from one carton to adjacent cartons when such cartons are mounted in adjacent relationship. In addition, to have the full dimensions of the dispensing opening available facilitates access to the individual medication doses. However, sometimes the carton lids can be bent or sometimes crushed into the dispensing opening, therefore inhibiting dispensing and otherwise minimizing the capacity of the dispensing system.

Another known approach for drug control and dispensing is described in U.S. Pat. No. 4,813,753. This approach relates to the use of a combination of a carton containing medicine and a releasably attachable tray lid attachable to the top flap of each carton. The lid is connectable to the top flap and includes a pair of hinge elements that are required for pivotal mounting on a tray for the device to operate as intended. In this regard, the tray is also formed with tray lid supporting structure for allowing the tray lid to pivot. Drawbacks associated with this approach are that it is rather cumbersome for the nurse to use. For instance, the nurse is continually involved with attaching and releasing the carton top to the lid during use of the carton. In this regard, the carton with a reorder label on it must first be attached to the tray lid and to do this the nurse must flex the box lid to attach the box lid to the tray lid. When it is time to reorder the drugs, the reorder label strip on the carton is used. However, to obtain this label, the nurse must release the carton lid from the tray lid and then remove the reorder label. Thereafter, the nurse must reattach the carton lid to the tray lid in a manner as noted before. Moreover, the foregoing approach is costly to manufacture because of its several costly components and the releasable attachment structure as well as the tray lid pivot design are not entirely reliable.

Accordingly, there is a continuing desire to improve upon the drawbacks noted in the prior art by providing an improved medication control and dispensing package assemblage.

SUMMARY OF THE INVENTION

The present invention relates to an improved medication dispensing package assemblage. Included is a medication control and dispensing assembly comprising: a medication dispensing carton having walls defining a medication dispensing opening, and a top wall portion made of bendable material and being connected to a portion of the walls in such a manner so as to be movable between a closed condition covering the medication opening and open conditions so as to permit withdrawal of medication from the carton. The top wall portion has connecting means adapted to be connected to a frame means. In combination with the carton is a frame means having locking means removably couplable with the connecting means and the frame means cooperates with the top wall portion for retaining the configuration of the top wall portion, thereby facilitating easy opening and closing of the bendable top wall portion and for supporting the top wall portion in such a manner so as to resist undesired bending thereof.

In another illustrated embodiment, the assembly further comprises an open top tray for removably supporting at least one of the medication dispensing cartons.

In another illustrated embodiment, the frame means includes at least a pair of spaced-apart locking tab projections which extend through openings in the top wall portion and removably cooperate with the underside surface of the top wall portion.

In another illustrated embodiment provision is made for a removable frame assembly adapted for cooperable use with a medication dispensing carton, wherein the carton has walls defining a medication dispensing opening, and a top wall portion made of bendable material and being connected to a portion of the walls in such a manner as to be movable between a closed condition covering the medication opening and open conditions which permits withdrawal of medication from the carton. In this embodiment the top wall portion has connecting means associated therewith which is adapted to be connected to a frame assembly. The frame assembly comprises removably locking means for removable coupling to the connecting means of the top wall portion and is constructed for cooperating with the top wall portion for retaining the configuration of the top wall portion, thereby facilitating easy opening and closing of the top wall portion and for supporting the top wall portion in such a manner so as to resist undesired bending thereof.

Accordingly among the objects of the present invention are the following: an improved drug control and dispensing assembly which facilitates proper dispensing of medication from a medication container; an improved drug control and dispensing assembly which is reliable and easy to use; an improved drug control and dispensing assembly which is inexpensive to manufacture and assemble; an improved drug control and dispensing assembly which includes an open top tray for at least a single container; an improved drug control and dispensing assembly which facilitates effective use in a medical cart; an improved drug control and dispensing assembly which tends to maintain the structural integrity of the top flap portion as well as the carton body structure; an improved frame assembly for use in association with a bendable top portion of a medication dispensing carton; and, an improved frame assembly as last noted which is easy to securely attach to a bendable top flap portion of a carton.

Other objects and further scope of applicability of the present invention will become apparent from the detailed description to follow when taken in conjunction with the accompanying drawings in which like parts are designated by like reference numerals throughout the several views.

DETAILED DESCRIPTION

Figure 1:
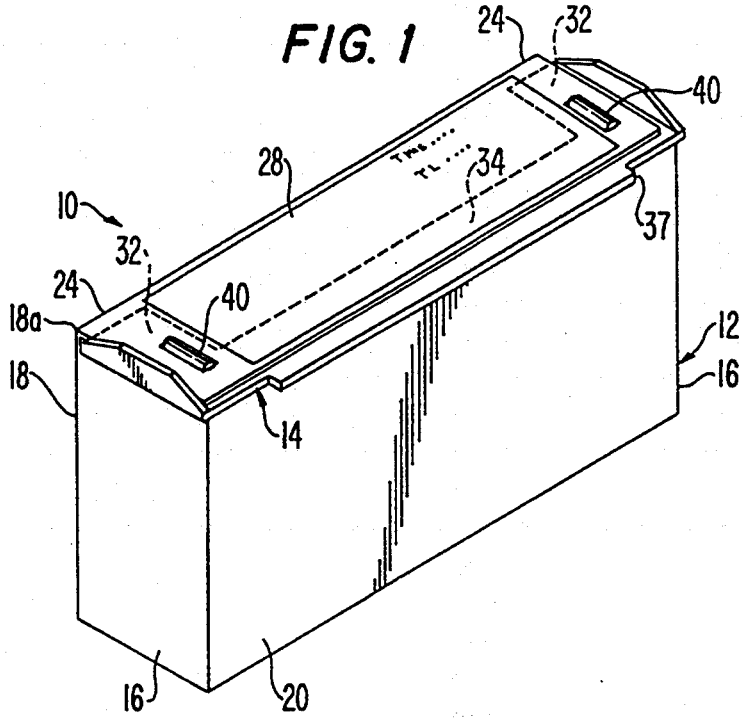
FIG. 1 is a perspective view of a medication control and dispensing assembly according to the present invention.
Figure 2:
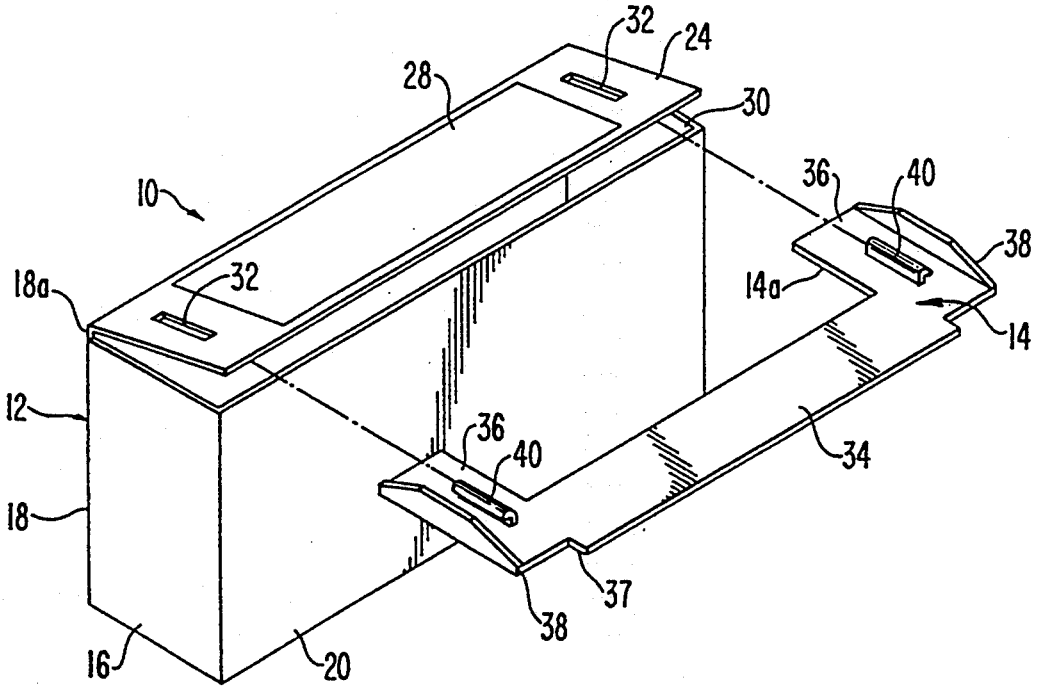
FIG. 2 is an exploded perspective view illustrating the components of the control and dispensing assembly in a disassembled condition.
Figure 3:
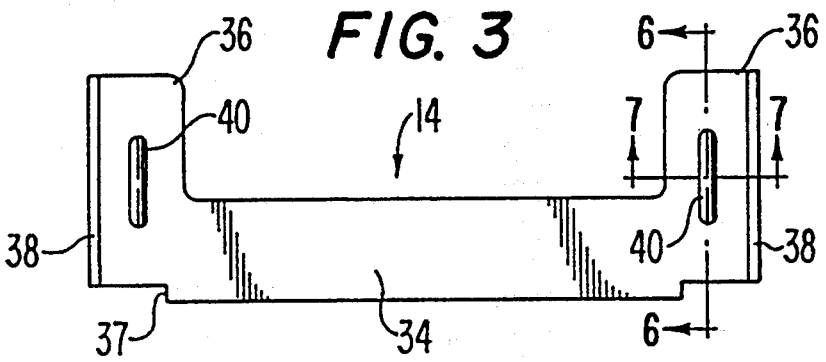
FIG. 3 is a top view of a frame assembly forming one aspect of the drug control and dispensing assembly of the present invention.
Figure 4:
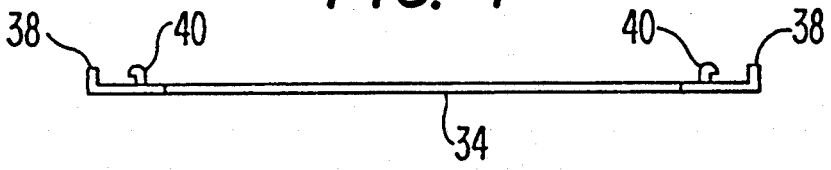
FIG. 4 is a side elevational view illustrating the frame assembly.
Figure 5:
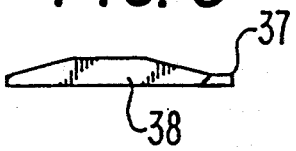
FIG. 5 is an end view of the frame assembly.
Figure 6:
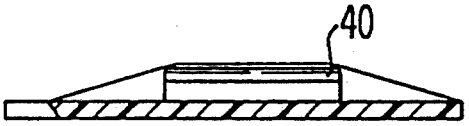
FIG. 6 is a cross-sectional view taken along the section line 6—6 appearing in FIG. 3.
Figure 7:
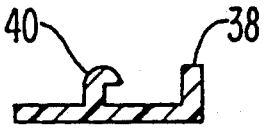
FIG. 7 is a cross-sectional view taken along the section line 7—7 appearing in FIG. 3.

Reference is made to FIG. 1 for disclosing aspects of an improved medication control and dispensing assembly 10 of the present invention. The assembly 10 includes a medicine containing carton 12 which cooperates with a frame assembly 14 in a manner to be described. The carton 12 of the illustrated embodiment has, preferably, a one-piece generally rectangular parallelpiped construction which includes a pair of sidewalls 16 opposed front and back walls 18 and 20; respectively, bottom wall 22 and a top wall or flap portion 24. It will be noted that the back wall 18 has a portion 18*a* which projects higher than the other upstanding walls. The top flap portion 24 is folded integrally with the back wall portion 18*a* so as to be foldable between open and closed positions. The carton 12 can be made from a variety of materials, but is, preferably, made of a cardboard material which therefore makes the top flap portion 24 bendable. The bendable top flap portion 24 has an upper surface 26 which is adapted to have placed thereon a label 28 including information concerning the medication, patient and other pertinent data for dispensing. The medication (not shown) to be dispensed can be in the form of pills, capsules, caplets or the like which are suitably packaged. The walls defining the carton 12 define a medication dispensing opening 30 which when opened allows access to the medication. Although not shown, it will be appreciated that the top flap portion 24 can be adhered to a side of the carton by reason of an adhesive strip (not shown), such as like that described in U.S. Pat No. 4,813,753. In addition, the top flap portion 24 is provided with a pair of spaced-apart generally rectangular slots 32 which, as will be described, cooperate with the frame assembly 14.

In the illustrated preferred embodiment, the frame assembly 14 has a generally rectangular shaped configuration (FIGS. 1–3 and 8) having a cut-out portion 14*a*. The frame assembly 14 can be made of a one-piece, rigid plastic material which is adapted to be securely attached or coupled to the top flap portion 24 in a manner to be described. In this embodiment, the U-shaped frame member 14 has a generally elongated central body portion 34 which will run coextensive with the length of the top flap portion 24. The frame member 24 also has extending laterally offset therefrom two leg portions 36. The leg portions 36 are offset relative to the body to define a lifting lip 37. Each leg portion 36 is provided with an upstanding lateral edge 38 which cooperates with the edges of the top flap portion 24. It will be appreciated that the frame is intended to have a thickness cooperable with the height of wall portion 18*a*. In addition, there is provided a locking means or tab portion 40 upstanding integrally from each leg portion 36. The tab portions 40 are adapted to protrude through the plane of the top flap portion 24, through the relatively smaller dimensioned slots 32, and engage and removably cooperate with the topside of the top flap portion 24. In this regard, the tab portions 40 have a generally J-shaped cross-sectional configuration. The foregoing construction tends to retain the one-piece frame assembly 14 in its desired position, but also allows the tab portions 40 to be removed from the flap 24. Also, the frame assembly 14 tends to maintain the bendable top flap portion 24 in a generally planar orientation which serves to facilitate not only the opening and closing of the medication opening 30, but serves to also prevent the top flap portion from being bent or otherwise crushed during usage. While the present invention discloses the use of a J-shaped locking tab portion 40 as illustrated, it will be appreciated that the present invention envisions other configurations as well as other means for connecting the frame assembly to the top flap portion. For instance, a locking tab can have an interference fit with the slot 32. Also, the frame can be attached to either the top or bottom surface of the top panel.

Because of the foregoing construction several advantages are achieved insofar as the top flap portion 24 has its planarity stabilized, thereby preventing the top flap portion from being crushed or otherwise bent as well as facilitates easy opening and closing of the opening 30 in a manner which does not, for instance, interfere with medicine carts, cabinets, trays and the like. The construction of the assembly 10 ensures the integrity of medication dispensing.

Figure 8:
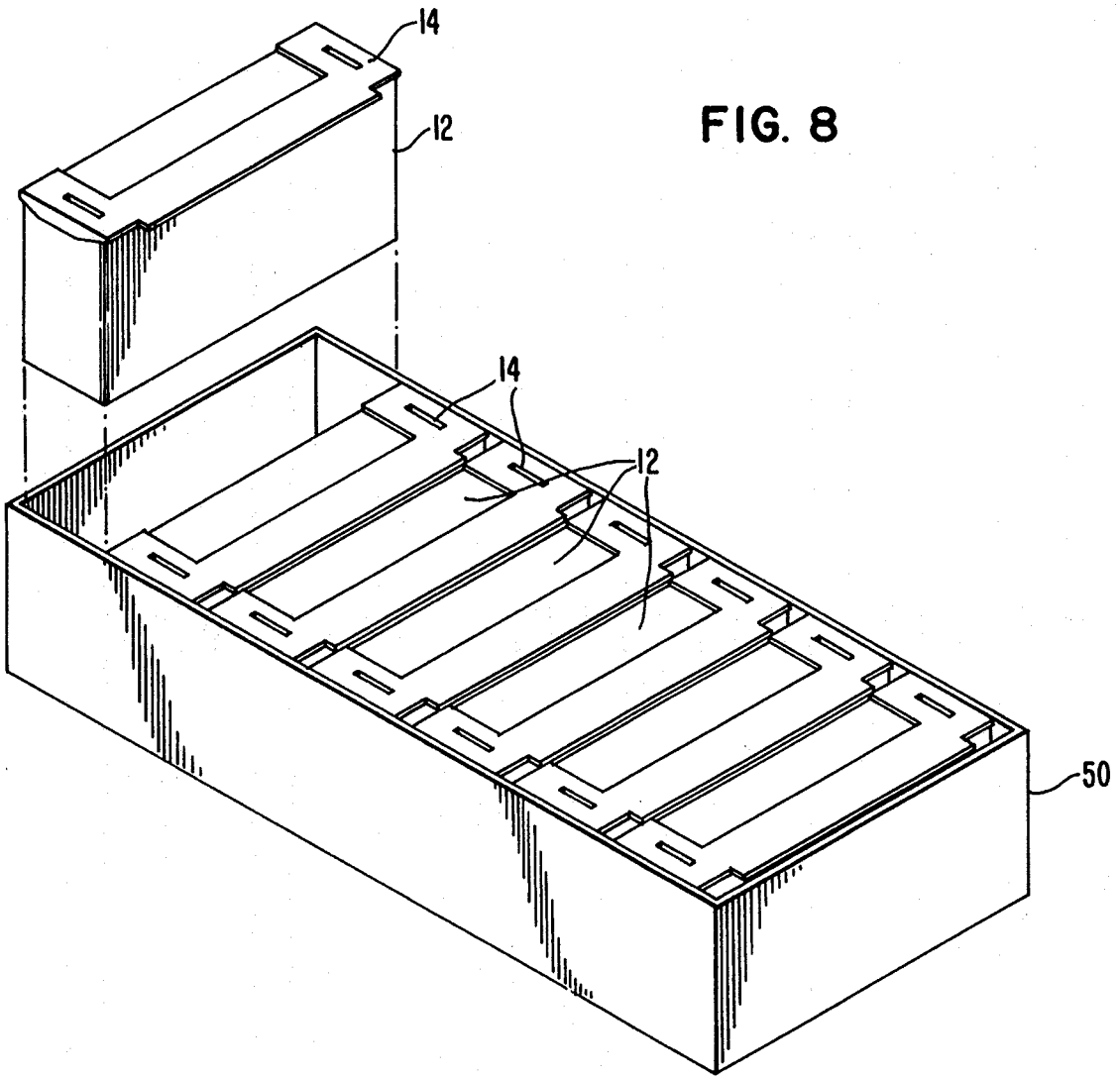
FIG. 8 is a perspective view disclosing several dispensing carton assemblages in an open tray therefor; and, FIGS. 9 and 10 are similar to FIGS. 1 and 2, but with the frame assembly attached to the top surface of a top flap of the carton.

As shown in FIG. 8, there is disclosed a tray 50 which has an open-top and is sized to accommodate several of the container and frame assemblies described above. The tray can be made of, for example, a plastic material and is adapted to be placed in a medicine cart or the like. Owing to the foregoing constructions there is provided an inexpensive yet highly reliable medication and package assemblage.

Figure 9:
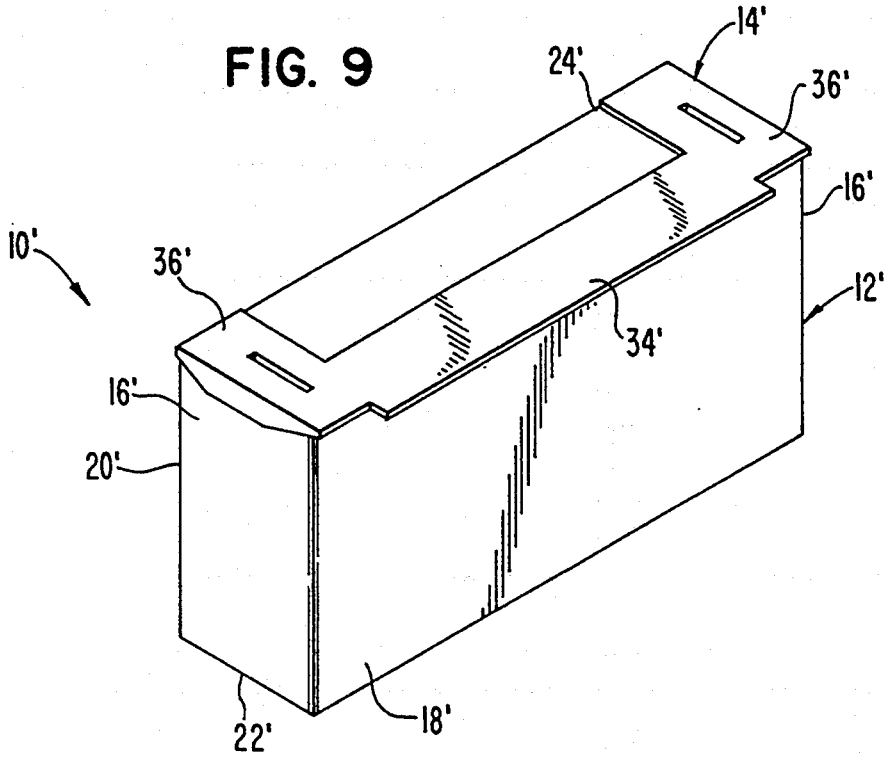
Figure 10:
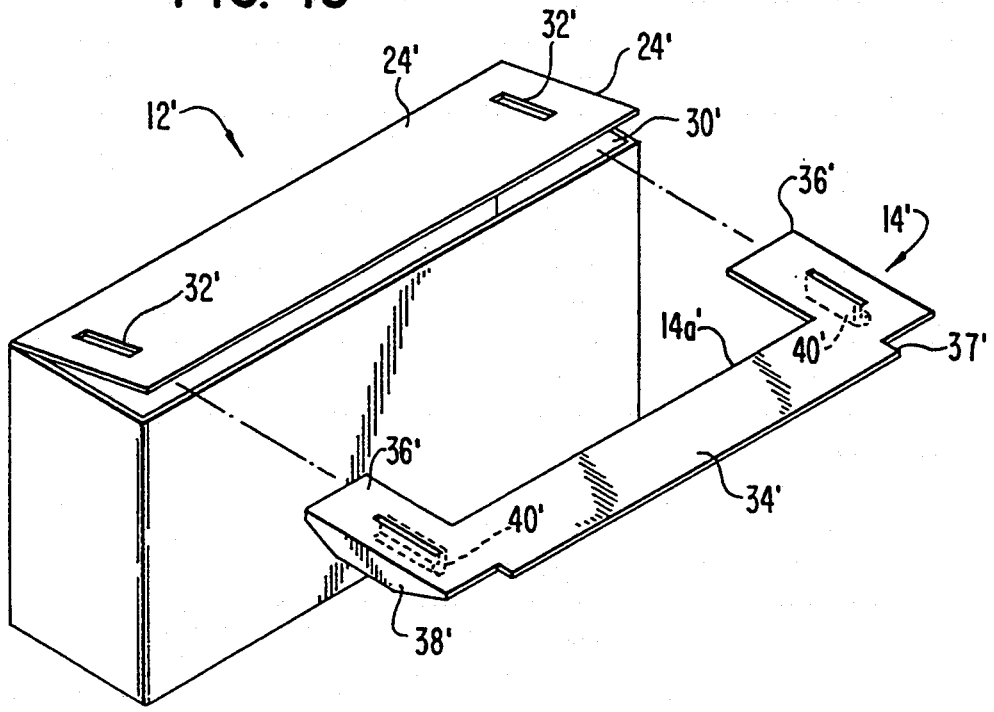

Reference is made to FIGS. 9 and 10 for disclosing an alternate embodiment of an improved medication control and dispensing assembly of the present invention. In this embodiment like structure will be represented by like reference numerals, but however, with the addition of a prime marking. One difference in this embodiment is that the frame assembly 14' is assembled on the top flap portion 24'. The assembly 10' includes a medicine containing carton 12' which cooperates with the frame assembly 14' in a manner to be described. The carton 12' of the illustrated embodiment has, preferably, a one-piece generally rectangular parallelpiped construction which includes a pair of sidewalls 16' opposed front and back walls 18' and 20'; respectively, bottom wall 22' and a top wall or flap portion 24'. It will be noted that the back wall 18' does not have a portion 18a' which projects higher than the other upstanding walls. The top flap portion 24 is folded integrally with the back wall portion 18a' so as to be foldable between open and closed positions. In this embodiment the backwall projection 18a' is not present. The bendable top flap portion 24' has an upper surface 26' which is adapted to have placed thereon a label 28' including information concerning the medication, patient and other pertinent data for dispensing. The walls defining the carton 12' define a medication dispensing opening 30' which when opened allows access to the medication. In addition, the top flap portion 24' is provided with a pair of spaced-apart generally rectangular slots 32' which, as will be described, cooperate with the frame assembly 14'.

In the illustrated alternate embodiment, the frame assembly 14' has a generally rectangular shaped configuration (FIGS. 9 and 10) having a cut-out portion 14a'. In this embodiment, the U-shaped frame member 14' has a generally elongated central body portion 34' having extending laterally offset therefrom two leg portions 36'. The leg portions 36' are offset relative to the body to define a lifting lip 37'. Each leg portion 36' is provided with a depending lateral edge 38' which cooperates with the edges of the top flap portion 24'. In addition, there is provided a removable locking means or tab portion 40' depending integrally from each leg portion 36'. The tab portions 40' are adapted to protrude through the plane of the top flap portion 24', through the slots 32', and engage and cooperate with the underside of the top flap portion 24'. In this regard, tab portions 40' have a generally J-shaped configuration. The foregoing construction tends to retain the one-piece frame assembly 14' in its desired position. Also, frame assembly 14' tends to maintain the bendable top flap portion 24' in a generally planar orientation which serves to facilitate not only the opening and closing of the medication opening 30', but serves to also prevent the top flap portion from being bent or otherwise crushed during usage. In addition, the cut-out 14a' configuration permits use of a reorder label that does not require the flap portion 24' to be released from the frame.

Changes may be made in the construction of the various elements, parts, and assemblies described herein without departing from the spirit and scope of the present invention as defined in the following claims.

What is claimed is:

1. A medication control and dispensing assembly comprising:

a medication dispensing carton having walls defining a medication dispensing opening, and a top wall portion made of bendable material and being connected to a portion of said walls in such a manner so as to be movable between a closed condition covering said medication opening and an open condition so as to permit withdrawal of medication from said carton, said top wall portion having connecting means adapted for connection with a frame means; and, frame means for supportive coupling with said medication dispensing carton, said frame means being securely mounted only to said top wall portion by retaining means removably coupable with said connecting means, said frame means cooperating with said top wall portion for retaining the configuration of said top wall portion.

2. The assembly of claim 1 wherein said frame means is constructed in a generally rectangular shaped configuration with a cut-out central portion for cooperating with said top wall portion.

3. The assembly of claim 2 wherein said frame means defines a pair of edge means for engagement with said top wall portion, each of said edge means being adapted to rest against an edge of said top wall portion, and said frame means defines a lifting lip portion.

4. The assembly of claim 1 wherein said retaining means includes at least a pair of spaced-apart projections which cooperate with said connecting means of said top wall portion so as to removably lock said frame to said top wall portion.

5. The assembly of claim 4 wherein each of said projections is an upstanding releasable locking tab, and said connecting means includes a slot adapted to removably receive each one of said tabs which protrude upwardly through said slots.

6. The assembly of claim 1 wherein said frame means is constructed in a generally rectangular shaped configuration with a cut-out central portion for cooperating with said top wall portion and thereby define an area which allows readability of indicia on a substantial area of said top wall portion when said frame means is mounted on a top surface of said top wall portion.

7. A frame adapted for cooperable use with a medication dispensing carton, the carton having walls defining a medication dispensing opening and a top wall portion made of bendable material and being connected to a portion of the sidewalls in such a manner as to be movable between a closed condition covering the medication opening and an open condition which permits withdrawal of medication from the carton, wherein the top wall portion has connection means adapted for connection to the frame assembly; said frame assembly comprising:

a retaining section for removable coupling to said connection means of the top wall portion, and said frame being constructed to cooperate solely with and being securely mounted to the top wall portion for retaining the configuration of the top wall portion.

8. The frame of claim 7 having a generally rectangular shaped configuration with a cut-out area for cooperating with the top wall portion.

9. The frame of claim 7 wherein said removable retaining section includes at least a pair of spaced-apart projections which removably cooperate with the connection means of the top wall portion.

10. The frame of claim 9 wherein in each of said projections is a depending tab which extends through a slot in the top wall portion and engages a surface of the top wall.

11. The frame of claim 10 further including a pair of edge means for engagement with said top wall portion, each of said edge means being adapted to rest against edges of said top flap portion and a lifting tip portion for enabling lifting of said frame.

12. The frame of claim 7 wherein having a generally rectangular shaped configuration with a cut-out area for cooperating with the top wall portion and thereby define an area which allows readability of indicia on a substantial area of the top wall portion.

13. An assembly comprising:

an open top tray assembly constructed to removably receive at least one medication control and dispensing assembly;

a medication control and dispensing assembly comprising: a medication dispensing carton having walls defining a medication dispensing opening, and a top wall portion made of bendable material and being connected to a portion of said walls in such a manner so as to be movable between a closed condition covering said medication opening and an open condition so as to permit withdrawal of medication from said carton, said top wall portion having connecting means adapted for connection with a frame means; and, frame means for supportive coupling with said medication dispensing carton, said frame means being securely mounted only to said top wall portion by retaining means removably couplable with said connecting means, said frame means cooperating with said top wall portion for retaining the configuration of said top wall portion.

* * * * *